US006190726B1

(12) United States Patent
Koskinen et al.

(10) Patent No.: US 6,190,726 B1
(45) **Date of Patent: *Feb. 20, 2001**

(54) METHOD AND APPARATUS FOR COATING A MOVING WEB OF PAPER OR PAPERBOARD USING A CONTROLLED COATING JET

(75) Inventors: Jukka Koskinen, Järvenpää (FI); Jukka Linnonmaa, Appleton, WI (US)

(73) Assignee: Valmet Corporation, Helsinki (FI)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/957,645

(22) Filed: Oct. 24, 1997

(30) Foreign Application Priority Data

Oct. 28, 1996 (FI) ..... 964346

(51) Int. Cl.[7] ..... B05D 1/02; B05C 11/02

(52) U.S. Cl. ..... 427/9; 427/8; 427/424; 118/672; 118/679; 118/688

(58) Field of Search ..... 427/424, 420, 427/296, 8, 9; 118/410, 672, 679, 688

(56) References Cited

U.S. PATENT DOCUMENTS

| | | | | |
|---|---|---|---|---|
| 4,124,342 | * | 11/1978 | Akatsuka et al. | 425/141 |
| 4,170,457 | * | 10/1979 | Tetro | 55/46 |
| 4,377,869 | | 3/1983 | Venalainen et al. . | |
| 4,427,722 | * | 1/1984 | Keller | 427/420 |
| 4,458,360 | | 7/1984 | Vanäläinen et al. . | |
| 4,639,942 | | 1/1987 | Puumalainen . | |
| 4,842,900 | * | 6/1989 | Miyamoto | 427/348 |
| 4,984,533 | * | 1/1991 | Takahashi et al. | 118/419 |
| 5,074,243 | | 12/1991 | Knop et al. . | |
| 5,149,341 | * | 9/1992 | Taylor et al. | 55/36 |
| 5,162,131 | | 11/1992 | Rantanen et al. . | |
| 5,505,995 | * | 4/1996 | Leonard | 427/348 |
| 5,510,150 | * | 4/1996 | Koskinen | 427/434.2 |
| 5,741,550 | * | 4/1998 | Paloviita et al. | 427/348 |
| 5,873,940 | * | 2/1999 | Takahashi et al. | 118/410 |
| 6,010,739 | * | 1/2000 | Ueberschar et al. | 427/8 |

FOREIGN PATENT DOCUMENTS 0 466 420 A3 1/1992 (EP) .

OTHER PUBLICATIONS

Search Report from Finnish Patent Office relating to the corresponding Finnish Patent Application, Serial No. 964346 (Aug. 1997).

Sep. 1992 Tappi Journal, pp. 161–169 Mechanism and prevention of coat weight nonuniformity due to high speed blade coating—Bryan J. Ortman and Douglas W. Donigian.

* cited by examiner

*Primary Examiner*—Shrive Beck
*Assistant Examiner*—Jennifer Calcagni
(74) *Attorney, Agent, or Firm*—Cohen, Pontani, Lieberman & Pavane

(57) ABSTRACT

A method and assembly for coating a moving web of paper or paperboard by means of a coating mix jet which is directed to the surface of the web without mechanical support. The present invention is based on applying a desired amount of the coating mix to the web via a narrow-gap slit orifice, and by measuring the coat weight on the web, adjusting the position of at least one lip of the slit orifice to achieve the desired weight and cross-machine profile of the applied coat.

23 Claims, 1 Drawing Sheet

METHOD AND APPARATUS FOR COATING A MOVING WEB OF PAPER OR PAPERBOARD USING A CONTROLLED COATING JET

FIELD OF THE INVENTION

The present invention relates to a method for coating a moving web of paper or paperboard by means of a coating mix jet directed to the surface of the web without mechanical support.

The invention also concerns an assembly suitable for implementing said method.

BACKGROUND OF THE INVENTION

Coater equipment based on applying the coat to the surface of a moving web by means of an unguided jet directed to the web surface are generally known in the art as jet nozzle applicators. In these jet nozzle applicators, the coating mix is applied to the web surface with the help of a separate jet-forming slit nozzle, whereby the equipment construction may be varied widely. The present invention concerns a jet-nozzle type applicator in which the coating mix is directed to the web surface as a narrow linear jet via a slit orifice extending over that portion of the cross-machine width of the web which is to be coated. This type of a coater is also known as a fountain coater. In the jet nozzle coater, or the fountain coater, the entire amount of required coat is transferred to the web surface. The application of the coat is performed while the surface of the web is running supported by a backing roll, and conventionally, the coat is smoothed immediately after application by means of a doctor blade adapted to the perimeter of the same backing roll. The operating parameters of the coating mix jet can be controlled by varying the slit opening width, jet angle and position of the slit orifice lips. This method of coat application is characterized by a very low loading of the web and relatively modest pumping volume of the coating mix, whereby the need for linear loading of the doctor blade remains smaller than in, e.g., a roll applicator, thus improving web runnability and increasing the life of the doctor blade.

In the European patent application No. 91306138.8 is described a jet nozzle applicator in which coat application occurs in the above-described manner. The apparatus comprises a rotating backing roll and a jet nozzle having a slit orifice adapted close to a web running supported by the backing roll. The coat is applied to the web through the slit orifice and subsequently doctored to the desired coat weight with the help of a doctor blade mounted close to the backing roll. The jet nozzle assembly is mounted to be rotatable such that the nozzle tilt angle with respect to the backing roll can be adjusted. The center of rotation for tilting of the nozzle assembly is arranged to be at the nozzle orifice exit opening, whereby the clearance of the nozzle orifice from the web remains constant during the adjustment of the nozzle angle with respect to the web.

Using a sufficiently high impact velocity and large volume of the coating mix jet stream, current jet nozzle coaters can be run at web speeds as high as about 1500–1600 m/min, however, with the penalty that the high mass flow rate of coat passed on the moving web to the doctor blade may readily cause the doctor blade to vibrate. To make doctoring easier, the amount of applied coating mix should be controlled to as close as possible to the final coat weight, which is difficult to accomplish in current coaters that do not lend themselves to operate at such low coat weights. However, if the amount of applied coat is kept below 150 g/m$^2$, doctoring can be performed at a relatively low linear loading of the blade, which means that theoretically a jet nozzle applicator should be able to manage these coat weights also at high web speeds. Herein, another problem arises at high web speeds in that the coating mix jet fails at these low coat weights to penetrate sufficiently well through the air layer travelling with the web, whereby the web tends to become marked with a large number of uncoated spots. Since the velocity of the coating mix jet stream cannot be increased above a certain limit, it is necessary to use a large amount of applied coat to cut through the air barrier. If the jet velocity is reduced with regard to the web speed, the mass flow rate of coating mix passed through the jet nozzle may be increased correspondingly; but even in this case the coat amount fed through the jet nozzle cannot be made very small. Typically, the exit velocity of the coating mix jet stream is 15–20% of the web speed, which means that a web speed of 20 m/s requires a coating mix jet stream velocity of 4–5 m/s.

In a jet nozzle applicator, the amount of coat applied to the web is in the order of 200–300 ml/m$^2$, from which the doctor blade removes 90–95%. Herein, the nozzle orifice gap width is set to about 0.7–1 mm, sometimes even as wide as 3 mm.

The smallest amount of coating mix that can be applied is determined by the gap width of the slit orifice. Obviously, while a narrower orifice allows a thinner coating mix jet stream to be ejected, a practical difficulty appears in the manufacture of straight lips for slit orifices having gap widths of less than one millimeter extending over the entire machine width with a high dimensional accuracy. In fact, to apply exactly the desired amount of coating mix to web, the gap width of the slit orifice should be controlled to 20–100 um. As the gap width of a slit orifice this narrow cannot be measured reliably by means of mechanical gauges, very expensive measurement devices of special design would be required for gauging the gap width of the slit orifice. On the basis of the above discussion, it is easy to see that, by virtue of a facility permitting direct application of a desired coat amount to the web, the doctoring step after the application of the coat would become redundant and also other benefits could be gained.

SUMMARY OF THE INVENTION

It is an object of the present invention to provide a method suited for direct coating of the surface of a moving web with a small amount of coating mix controlled to be equivalent to the desired coat weight.

The goal of the present invention is achieved by applying the desired amount of coat to the web via an extremely narrow slit orifice and then measuring the coat weight of the coated web, whereby the position of at least one lip in the jet nozzle assembly is adjusted in order to control the coat weight and the cross-machine coat profile to desired values.

More specifically, the method according to the present invention comprises measuring the weight of the coat applied to the web and varying the volume rate of the coating mix sprayed at multiple points across the width of the web to obtain a desired coat thickness after drying.

Furthermore, the assembly according to the present invention comprises a coating mix jet applicator, a means for gauging the coat weight applied to the web by the jet applicator, and a means for controlling the volume rate of the coating mix sprayed by the jet applicator.

The present invention offers significant benefits.

The principal advantage of the present invention is that the web can be coated with an accurately controlled amount of coating mix, whereby doctoring will become redundant.

In the present coating method, the coat forms a contour-like surface texture, similar to that of air-brush coating, which is easy to smooth by calendering. The coating power of such a surface texture is high, making the method most suitable for coating paper and paperboard grades of low base sheet brightness. Since no excess coat is applied to the web, the method needs no return circulation of coat overflow and the coating mix applied to the web is always taken from a supply of virgin, clean coat furnish. As a result, the straining and removal of entrained air from the coating mix furnish will become easier, because the coating mix feed system never contains recirculating coating mix degraded by entrained air and coat lumps. Moreover, since no mechanical load is inflicted on the web being coated and no doctoring is required, extremely good web runnability is achieved. The first coat layer may be immediately covered with a second coat layer without intermediate drying, because the application of a second coat layer on the web takes place as readily on a wet first coat layer as on an uncoated base sheet. Optionally, the first coat layer may be applied using any alternative method. For instance, the first coat layer may be applied using a blade coater, which is a method well-known to form a smooth coat surface with the coating mix filling the roughness of the base web profile. If a coat layer of high coating power is then applied on such a smooth first coat layer by virtue of the method according to the present invention, a very high final coat quality will be attained.

With regard to the consumption of the coating mix, a smaller volume of coat furnish will suffice, because no extra volume of recirculating coat is needed. The method can be adapted to cover a wide range of coat weights. The lightest possible coat weight is determined by the narrowest realizable gap width of the slit orifice and the heaviest applicable coat weight is limited to the maximum amount of coating mix that can be carried by the web as a smooth layer. Thus, the method can provide in a single coating step a coat weight as high as that achievable in multilayer coating. The thickness range of the applied coat layer is not dependent on the qualities of the base paper, because the application inflicts no stress on the web. As a result, a thick coat can be applied also to a thin base sheet without compromising the web runnability.

An applicator apparatus according to the present invention can be adapted very rapidly to accommodate different coat weights and paper grades. The memory of the control computer can be used to store separately for each manufactured paper grade the optimal values of such control parameters as web speed, jet angle and exit velocity, coat feed pressure, desired coat weight and the others. Hence, at the coater startup phase toward the web "steady-state" running speed, the coat weight will immediately assume the correct or almost correct value. As the method includes a continuous coat weight and profile measurement and control, the apparatus is capable of rapidly compensating for wear of the slit orifice lips and other changes caused by varying operating conditions, whereby the coat weight attains its correct value very rapidly.

The apparatus has a compact design and lends itself to be adapted in a desired position with respect to the web, also above the web. This facility makes the design of the apparatus significantly easier with respect to prior-art embodiments. The present invention may be exploited as a complementary part to existing coater stations so that the application step is followed by a doctor blade assembly or other smoothing device. Also in these arrangements, the accurate coat metering of the present method offers improved runnability and good coat surface quality.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

In the following description, the term desired or target value of applied coat refers to the amount of coat that shall stay adhering to the web surface after drying, that is, the desired final coat weight. Correspondingly, in multilayer coating, the term desired amount of coat is used to refer to the weight contribution of each coat layer in the final coat weight.

The term slit orifice width is used to refer to the gap width between the orifice lips, while the term orifice length refers to the cross-machine length of the slit orifice.

Figure 1:
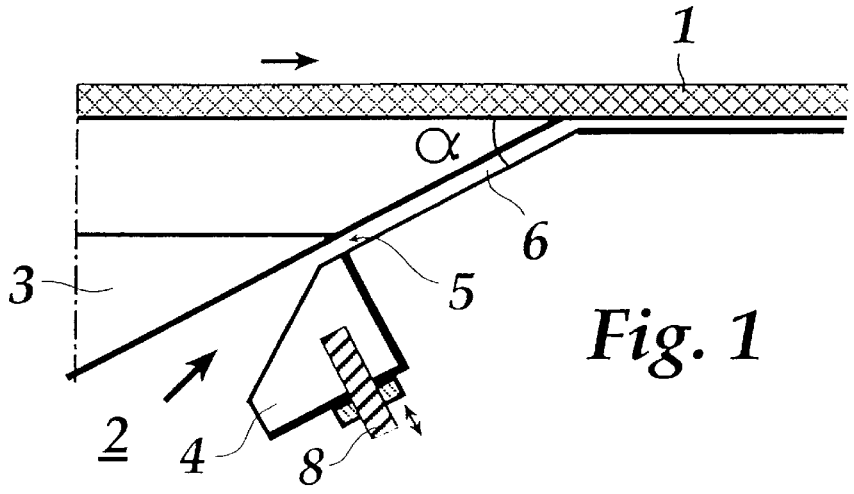
FIG. 1 shows a schematic diagram of the apparatus according to the present invention.

Referring to FIG. 1, the applicator apparatus shown therein is adapted to operate against an unsupported web 1. Owing to the nonloading application technique of the method, the coating can be carried out on a belt-supported web, or even an unsupported web as illustrated in the drawings, which arrangement is different from that of conventional coaters based on coating a backing-roll-supported web. The coater assembly comprises a chamber 2, wherefrom exits a slit nozzle orifice 5 formed by a fixed lower lip 3 and an adjustable upper lip 4. To permit the volume rate of applied coating mix to be adjusted sufficiently small, the slit orifice 5 must be made very narrow. Typically, the gap width of the slit orifice must be in the order of 20–100 um, but in some cases an orifice as wide as 200 um can be used. The present applicator is suited for a wide range of coat weights and web speeds, whereby the web speed may be in the range 100–3000 m/s and the final coat weight in the range 3–30 g/m$^2$. One of the parameters affecting the coat amount transferred to the web 1 is the speed differential between the coating mix jet 6 and the web. The exit velocity of the jet 6 may be controlled by varying the internal pressure of the chamber 2, whereby the jet velocity may be set to 20–110% of the web speed. Also the tangential angle $\alpha$ of the coating mix jet 6 with respect to the web can be selected relatively freely, but most advantageously the jet is directed at a slant angle of about 30° downstream with respect to the travel direction of the web surface.

Figure 2:
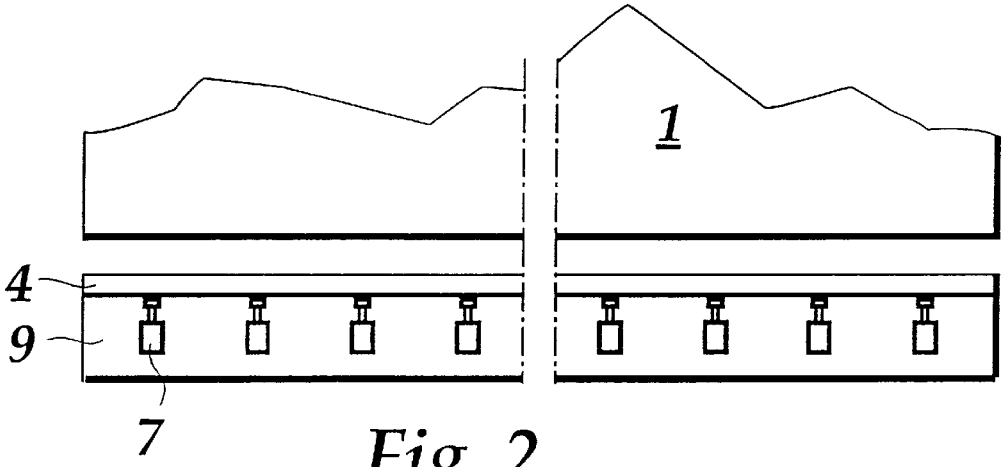
FIG. 2 shows a side view of the apparatus according to the present invention.

The narrow-gap slit orifice 5 is extremely demanding as to its manufacturing tolerances, and even the slightest mechanical wear will alter the dimensions of the orifice gap. Since coat formulations are made as mixtures of mineral pigments with water, they are extremely abrasive to the equipment. In order to compensate for dimensional deviations of the slit orifice gap due to manufacturing tolerances and wear, the position of the upper lip 4 is arranged to be controllable by means of continuously operating adjustment jacks 7. As shown in FIG. 2, the jacks 7 are mounted on the coater frame 9 and their screws 8 driven by electrical motors that abut the upper lip 4 of the slit orifice 5. The amount of coat applied to the web 1 is measured and the position of the upper lip 4 is adjusted on the basis of this measurement information. As the coat weight gauges currently used are capable of extremely high definition and the lip control system can achieve a positioning precision of a few micrometers, the coat weight and profile can be controlled to desired values with a sufficiently high accuracy. Although the gap width of the slit orifice itself cannot be manufactured exactly to required values and the mechanical wear of the gap tends to increase the amount of applied coating mix, the profile control arrangement based on coat weight measurement is capable of compensating for both runtime changes in operating conditions as well as slit orifice gap width deviations due to manufacturing tolerances that affect the volume rate of the coating mix jet.

Figure 3:
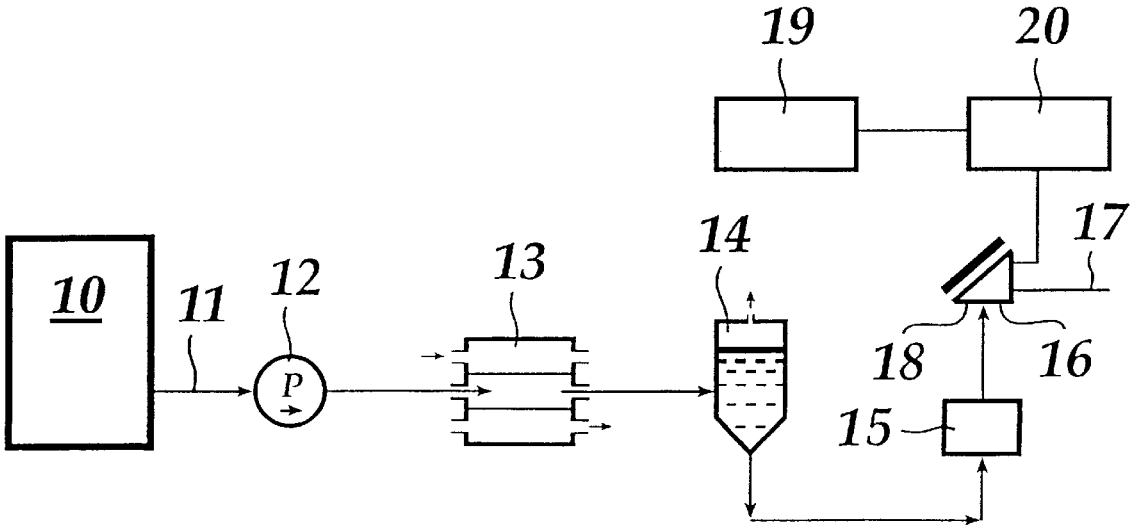
FIG. 3 shows a schematic diagram of the coating mix feed system in the apparatus according to the present invention.

Now referring to FIG. 3, therein is illustrated an arrangement for feeding the coating mix into the applicator according to the present invention. An essential property of the present concept is that no return circulation of excess coat is needed, simply because no excess coat is applied to the web. The formulated coat is placed in a feed container 10, wherefrom it is pumped along a feed line 11 by means of a pump 12 to the applicator assembly 16. In modern coat formulations having a high solids content, the viscosity will become so high that the coating mix is difficult to force out via the narrow gap of the slit orifice. Hence, the pressure in the feed line 11 must be elevated by the pump 12 sufficiently high to achieve the required exit velocity of the coating mix jet. As the pressure level needed herein is dependent on the viscosity of the coat formulation, the gap width of the slit orifice 5 and the desired exit velocity of the coating mix jet, typically a pressure level of about 1–3 MPa must be used.

Due to the extremely narrow gap width of the slit orifice 5 of the jet nozzle assembly, the coat formulation must be strained very effectively prior to its feed to the applicator assembly 16. The strainer 15 is placed in-line as close as possible to the applicator 16 in order to avoid coat lumps possibly formed within the feed line 11 from entering the applicator 16. Since the mesh of the strainer 15 must be so fine as to permit removal of particles larger than the gap width of the slit orifice 5, ultrafiltration techniques are advantageously used. Additionally, a second strainer can be placed in the coating mix chamber 2 of the applicator 16. Furthermore, entrained air must be removed effectively from the coating mix, whereby the size of air bubbles in the coating mix shall be smaller than the gap width of the slit orifice 5. In the embodiment of FIG. 3, air removal is performed with the help of a centrifugal air separator 14 placed in the feed line in front of the strainer 15. Air removal and filtration is relaxed by the fact that the system has no return circulation, whereby there is no need to arrange into the coating mix container 10 a strainer for a flow of recirculating coating mix containing a great amount of entrained air and possibly coat lumps and other impurities, as is conventionally needed in prior-art coaters. In contrast, the applicator 16 is now fed with virgin coating mix which is easily treated by straining and air removal prior to its entry into the coating mix feed container 10, and moreover, the air separator 14 and the strainer 15 mounted in the coating mix feed line 11 provide the final guarantee of feeding the applicator 16 with a high-quality coating mix. In addition to straining and air removal, the coating mix can be heated or cooled by means of a heat exchanger 13 mounted in the coating mix feed line 11.

Since the applicator apparatus according to the present invention is capable of applying very light coat weights to the web surface, the coating mix jet cannot penetrate through the air layer travelling along with the moving web. Hence, the air layer must be removed from the web surface before the web meets the coating mix jet. This task can be performed using mechanical doctor devices, such as an air knife directed reverse to the machine direction of the travelling web or a suction device, whereby the air layer removing device is placed just in front of the coating mix jet. However, most advantageously the applicator assembly 15 is adapted into a vacuum chamber 18, thus using a vacuum for preventing the escape of the coat mist to the environment. Simultaneously, the above-mentioned air-removal devices can be used for preventing the entry of air into the vacuum chamber.

The amount of applied coating mix is adjusted to the desired value by means of a control circuit including a coat weight gauge 19. Such coat weight gauging can be performed using any conventional measurement equipment whose function need not be described herein more precisely. The amount of applied coating mix is adjusted to its target value during system startup by means of varying the position of the upper lip in the jet nozzle applicator apparatus with the help of adjustment jacks 7 according to the measurement signal submitted by the coat weight gauge 19. The control of the final coat weight is performed by moving the upper lip 4 with the help of all jacks simultaneously in order to make the coat weight lighter or heavier, whereby the gap width of the slit orifice 5 is made smaller or larger, respectively. The coat profile is made level by controlling each of the jacks 7 separately on the basis of the measured coat profile. The profile control facility may also be used to some extent in compensating for the profile errors of the base sheet by adjusting the amount of coating mix applied to different areas of the web. Most advantageously, a computer 20 is used for processing the measurement values and computing the set values for the adjustment jacks. The computer 20 may be a separate unit, or alternatively, the required control software can be compiled into an integral part of the control software of the entire coater station. During the operation of the applicator apparatus, the set values for different coat weights are stored in the memory of the control system, whereafter these stored parameters can be used as initial values for altering the coat weight, web speed or other parameters, thus permitting very rapid product changes and reducing the amount of broke.

In addition to or instead of the control of the lip position of the slit orifice, the profile control of the linear coating mix jet applied to the web can be implemented by diluting the coating mix jet at selected points with water just prior to the spraying of the coat on the moving web. Herein, a jet section ejecting diluted coating mix gives an area of thinner final coat on the web, whereby a plurality of water injection nozzles placed in the applicator chamber make it possible to implement the coat profile adjustment by way of adjusting the cross-machine solids content profile of the coating mix jet. The diluting water can be fed to the applicator assembly 16 via a water infeed nozzle 17.

In addition to those described above, the invention may have alternative embodiments. For instance, the above-mentioned adjustment jacks 7 can be replaced by other types of high-precision positioning devices. As the required control range is very small, the lip actuators need not produce a high force, since the upper lip of the slit orifice can be readily flexed by the required amount. Instead of the upper lip, the lower lip or even both lips can be adjusted. The preferred adjustment technique must be selected according to the desired tilt angle of the coating mix jet with respect to the web. If the jet is aligned downstream to the machine direction of the web, the upper lip is most advantageously adjusted as described above. The shape of the lips 3, 4 may be varied from that shown in the diagrams.

After the application of coating mix in accordance with the present invention, the web can be subjected to further treatment in a desired manner. For instance, the web can be smoothed with the help of a doctoring device, or alternatively, calendered in order to improve the smoothness of the web.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a moving web of paper or paperboard comprising:

applying coating mix to a surface of a moving web of paper or paperboard in a jet ejected from a slit orifice of an applicator, the slit orifice extending across at least a portion of a width of the moving web, the coating mix being applied at a volume rate of flow through the slit orifice, the slit orifice being formed by a first lip and a second lip;

measuring a weight of the coating mix that has been applied to the surface of the moving web by the jet; and controlling the volume rate of flow of coating mix ejected from the slit orifice of the applicator at a plurality of points across at least a portion of the width of the web so that the coating mix applied to the surface of the web achieves a desired coating thickness after drying of the web and the applied coating, the volume rate of flow being controlled based upon measuring of the weight of the coating mix that has been applied to the web by the applicator, the volume rate of flow being controlled so that the desired coating thickness is obtained without doctoring of the applied coating mix.

2. The method of claim 1, wherein controlling the volume rate of flow of the jet is achieved by adjusting a distance between the first lip and the second lip at a plurality of points across at least a portion of the width of the web.

3. The method of claim 1, wherein controlling the volume rate of flow of the jet is achieved by adjusting a water content of the coating mix prior to applying the coating mix to the surface of the web.

4. The method of claim 2, wherein controlling the volume rate of flow of the jet is achieved by adjusting a water content of the coating mix prior to applying the coating mix to the surface of the web.

5. The method of claim 1, wherein a distance between the first lip and the second lip is an average of less than 200 $\mu$m.

6. The method of claim 1, wherein a distance between the first lip and the second lip is an average of less than 100 $\mu$m.

7. The method of claim 2, wherein the distance between the first lip and the second lip is adjusted by moving at least one of the first lip and the second lip.

8. The method of claim 1, wherein air carried along with the surface of the web is doctored away from the surface of the web prior to applying of the coating mix to the surface of the web.

9. The method of claim 1, wherein air carried along with the surface of the web is removed by vacuum prior to applying of the coating mix to the surface of the web.

10. The method of claim 1, further comprising:

feeding the coating mix under pressure to the slit orifice of the applicator;

removing entrained air from the coating mix before the coating mix is fed to the slit orifice of the applicator; and straining the coating mix before the coating mix is fed to the slit orifice of the applicator.

11. The method of claim 1, wherein the slit orifice extends across an entire width of the web.

12. The method of claim 1, wherein the coating mix applied to the surface of the moving web is virgin coating mix that has not previously been applied to the web.

13. An apparatus for coating a moving web of paper or paperboard comprising:

an applicator for applying coating mix to a surface of a moving web of paper or paperboard in a jet ejected from a slit orifice of the applicator, the slit orifice extending across at least a portion of a width of the moving web, the slit orifice being formed by a first lip and a second lip;

a means for measuring a weight of the coating mix that has been applied to the surface of the moving web by the applicator; and a control means for controlling the volume rate of flow of coating mix ejected from the slit orifice of the applicator at a plurality of points across at least a portion of the width of the moving web so that the coating mix applied to the surface of the web achieves a desired coating thickness after drying of the web and the applied coating, the volume rate of flow being controlled based upon measuring by the measuring means of the weight of the coating mix that has been applied to the moving web by the applicator, the volume rate of flow being controlled so that the desired coating thickness is obtained without doctoring of the applied coating mix.

14. The apparatus of claim 13, wherein a distance between the first lip and the second lip is adjustable at a plurality of points across at least a portion of the width of the web.

15. The apparatus of claim 13, wherein a distance between the first lip and the second lip is an average of less than 200 $\mu$m.

16. The apparatus of claim 13, wherein a distance between the first lip and the second lip is an average of less than 100 $\mu$m.

17. The apparatus of claim 14, wherein the distance between the first lip and the second lip is adjustable by moving at least one of the first lip and the second lip.

18. The apparatus of claim 13, further comprising a doctoring means for doctoring away air carried along with the surface of the web, said doctoring means being positioned before coating mix is applied to the surface of web by said applicator.

19. The apparatus of claim 13, further comprising a vacuuming means for vacuuming away air carried along with the surface of the web, said vacuuming means being positioned before coating mix is applied to the surface of web by said applicator.

20. The apparatus of claim 13, further comprising:

a pump for feeding the coating mix under pressure to the slit orifice of the applicator;

an air separator for removing entrained air from the coating mix before the coating mix is fed to the slit orifice of the applicator; and a strainer for straining the coating mix before the coating mix is fed to the slit orifice of the applicator.

21. The apparatus of claim 13, further comprising a means for adding water to the coating mix before the coating mix is fed to the slit orifice of the applicator.

22. The apparatus of claim 13, wherein the slit orifice extends across an entire width of the web.

23. The apparatus of claim 13, further comprising a means for supplying to said applicator virgin coating mix that has not previously been applied to the web.

* * * * *